US006462716B1

(12) United States Patent
Kushihi

(10) Patent No.: US 6,462,716 B1
(45) Date of Patent: Oct. 8, 2002

(54) ANTENNA DEVICE AND RADIO EQUIPMENT HAVING THE SAME

(75) Inventor: Yuichi Kushihi, Kanazawa (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/921,246

(22) Filed: Aug. 2, 2001

(30) Foreign Application Priority Data

Aug. 24, 2000 (JP) ..... 2000-254208

(51) Int. Cl.[7] ..... H01Q 1/50
(52) U.S. Cl. ..... 343/860; 343/702; 333/32
(58) Field of Search ..... 343/700 MS, 702, 343/860; 333/32, 33, 132, 173

(56) References Cited

U.S. PATENT DOCUMENTS 5,258,728 A * 11/1993 Taniyoshi et al. ..... 333/132
5,493,311 A * 2/1996 Itoh et al. ..... 343/860
5,734,355 A * 3/1998 Watanabe ..... 333/25
5,874,926 A * 2/1999 Tsuru et al. ..... 343/713
5,999,135 A * 12/1999 Nozaki et al. ..... 343/713
6,075,491 A * 6/2000 Dakeya et al. ..... 343/700 MS

FOREIGN PATENT DOCUMENTS

JP 10322122 4/1998
JP 11177331 7/1999

* cited by examiner

*Primary Examiner*—Tan Ho
(74) *Attorney, Agent, or Firm*—Ostrolenk, Faber, Gerb & Soffen, LLP

(57) ABSTRACT

An LC parallel resonance circuit is connected in series with the power supply side of the antenna conductor portion. The antenna conductor portion is configured so as to resonate at a frequency slightly lower than the center frequency in the higher frequency band of two frequency bands for transmitting and receiving radio waves. The LC parallel resonance circuit is configured so as to resonate substantially at the center frequency in the lower frequency band for transmitting and receiving a radio wave and be capable of providing to the antenna conductor portion a capacitance for causing the antenna conductor portion to resonate at the center frequency in the higher frequency band. Thus, a circuit for changing the upper and lower frequency bands is not needed. Such a change-over circuit, which is complicated, causes problems in that the conduction loss increases, and the antenna sensitivity deteriorates. Without need of the change-over circuit, the conduction loss can be reduced, the antenna sensitivity can be enhanced and costs can be reduced.

22 Claims, 16 Drawing Sheets

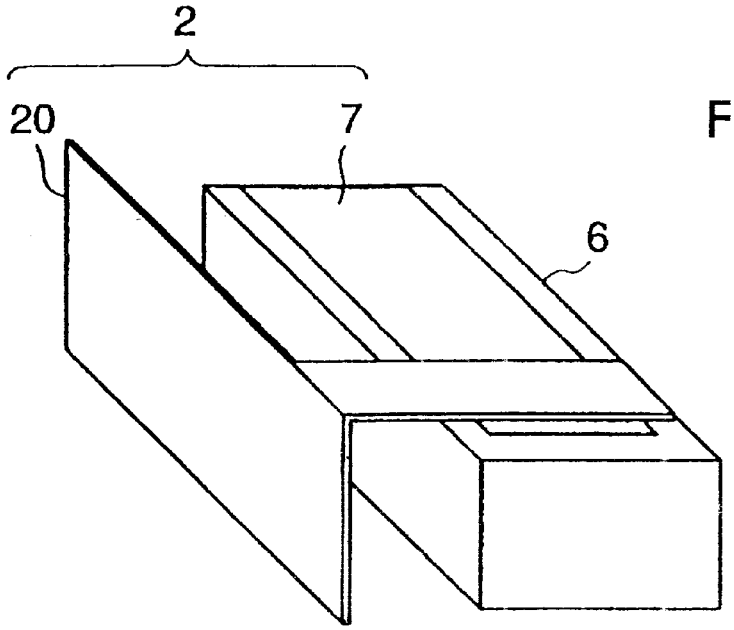
FIG. 7A
FIG. 7B
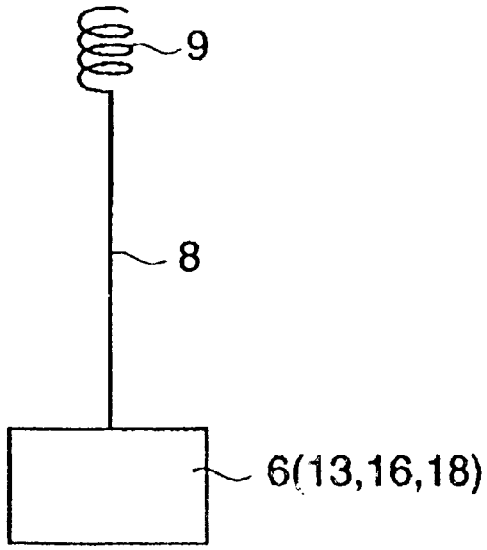

ANTENNA DEVICE AND RADIO EQUIPMENT HAVING THE SAME

BACKGROUND OF THE INVENTION

1. Field of the Invention

The present invention relates to an antenna device which is contained in radio equipment such as a portable telephone, and so forth, and to radio equipment provided with the same.

2. Related Art

FIG. 18 schematically shows an example of a dual band type antenna device. An antenna device 40 shown in FIG. 18 can transmit or receive radio waves in two different frequency bands, and comprises an antenna conductor portion 41, an inductor portion 42, a change-over circuit 43 for changing the inductance of the inductor portion 42, and an inductor 44 which functions as a matching circuit.

The antenna conductor portion 41 has, for example, a form of a conductor wire member such as a whip antenna or the like, a conductor film formed on the surface of a rectangular parallelepiped substrate, and so forth. The inductor portion 42 is connected in series with the power supply side of the antenna conductor unit 41, and the inductance component of the inductor portion 42 is coupled to the antenna conductor unit 41. The inductance of the antenna conductor portion 41 can be equivalently changed by changing the inductance of the inductor portion 42 by means of the change-over circuit 43. Thus, the inductor portion 42 can resonate in two different frequencies when the changing is carried out. Accordingly, the antenna device 40 can transmit and receive radio waves in the two different frequency bands.

However, for the above-described configuration of the antenna device 40, a complicated change-over circuit as shown in FIG. 18 is needed, when two frequency bands significantly distant from each other, such as a PDC (personal digital cellular) 800 MHz band and a PDC 1.5 GHz band, are changed. Thus, problems arise in that the number of parts of the change-over circuit 43 is large, increasing the cost, the conduction loss in the change-over circuit 43 is large, reducing the antenna sensitivity, and so forth.

SUMMARY OF THE INVENTION

Accordingly, it is an object of the present invention to solve the above-described problems and provide an antenna device which can transmit and receive radio waves in two different frequency bands and is inexpensive, and radio equipment including the same.

To solve the above-described problems and achieve the above object, according to the present invention, there is provided an antenna device which can transmit and receive radio waves in two different frequency bands, comprising an antenna conductor portion having a resonance frequency which is lower than the center frequency in the higher frequency band for carrying out the transmission and reception of the radio waves and is higher than the center frequency in the lower frequency band for carrying out the transmission and reception of the radio waves, and an LC parallel resonance circuit connected in series with the power supply side of the antenna conductor portion, the LC parallel resonance circuit being configured so as to resonate at a frequency nearly equal to the center frequency in the lower frequency band, causing the antenna conductor portion to resonate at the center frequency in the lower frequency band, and so as to provide a capacitance for causing the antenna conductor portion to resonate at the center frequency in the higher frequency band.

Preferably, the antenna conductor portion comprises a conductor sheet member or conductor wire member having an electrical length equal to about one quarter of the wavelength of a radio wave having a frequency between the center frequency in the higher frequency band and the center frequency in the lower frequency band.

Also, preferably, the antenna conductor portion comprises a conductor sheet member, and has an electrical length equal to about one quarter of the wavelength of a radio wave having a frequency between the center frequency in the higher frequency band and the center frequency in the lower frequency band.

Preferably, the antenna conductor portion comprises a combination of the conductor portion for transmitting and receiving a radio wave, formed on a substrate, and a conductor sheet member or conductor wire member electrically connected to each other, and the combination has an electrical length equal to about one quarter of the wavelength of a radio wave having a frequency between the center frequency in the higher frequency band and the center frequency in the lower frequency band.

Also, preferably, the capacitor portion constituting the LC parallel circuit is configured so as to contain at least a varicap diode having a parasitic capacitance variable depending on applied voltage, and a voltage input portion for determining the parasitic capacitance of the varicap diode is electrically connected to the capacitor portion.

More preferably, a change-over circuit for changing the inductance of the inductor portion constituting the LC parallel resonance circuit in plural steps to vary and set the lower frequency band is connected to the inductor portion constituting the LC parallel resonance circuit.

Preferably, the inductor portion comprises plural inductors connected in series to each other, a bypass conduction path is provided in parallel to at least one of the plural inductors constituting the inductor portion, and a switching portion for controlling the conduction on-off of the bypass conduction path whereby the conduction on-off of the inductor connected in parallel to the bypass conduction path is incorporated in the bypass conduction path, the bypass conduction path and the switching portion constitute the change-over circuit for changing the inductance of the inductor portion to vary and set the lower frequency band.

Radio equipment according to the present invention is characterized in that the equipment includes one of the above-described antenna devices.

According to the present invention, the LC parallel resonance circuit is connected in series with the power supply side of the antenna conductor portion. Since the LC parallel resonance circuit resonates at a frequency nearly equal to the center frequency in the lower frequency band for transmitting and receiving a radio wave, an inductor component, caused by the LC parallel resonance circuit, is rendered to the antenna conductor portion, and thereby, the antenna conductor portion resonates at the center frequency in the lower frequency band to carry out the operation as an antenna.

The antenna conductor portion has a resonance frequency which is lower than the center frequency in the upper frequency band. The LC parallel resonance circuit presents a capacitive impedance characteristic in the upper frequency band higher than the resonance frequency of the circuit. Thus, the capacitance of the LC parallel resonance circuit is connected in series with the power supply side of the antenna conductor portion in the frequency band higher than the resonance frequency of the LC parallel resonance circuit, so that the inductance of the antenna conductor portion is reduced. As a result, the antenna conductor portion resonates at a frequency higher than the resonance frequency of the antenna conductor portion itself. Accordingly, the antenna conductor portion can resonate at the center frequency in the higher frequency bands and thus, can operate as an antenna by setting the circuit constants of the LC parallel resonance circuit so that the antenna conductor portion can resonate at the center frequency in the higher frequency band.

The antenna conductor portion can transmit and receive radio waves in the two different frequency band, due to the simplified configuration in which the LC parallel resonance circuit is connected in series with the antenna conductor portion without need of a circuit for changing the upper and lower frequency bands.

In the arrangement of the present invention, no complicated circuits for changing the upper and lower frequency bands are provided as described above. Thus, the circuit configuration becomes simple, and the conduction loss can be reduced. Accordingly, the antenna sensitivity can be enhanced, and increase in cost can be prevented.

BRIEF DESCRIPTION OF THE DRAWING(S)

FIG. 1 schematically shows the characteristic configuration of an antenna device according to a first embodiment of the present invention;

FIG. 7A illustrates yet another example of the form of the antenna conductor portion;

FIG. 7B illustrates still another example of the form of the antenna conductor portion;

Figure 8:
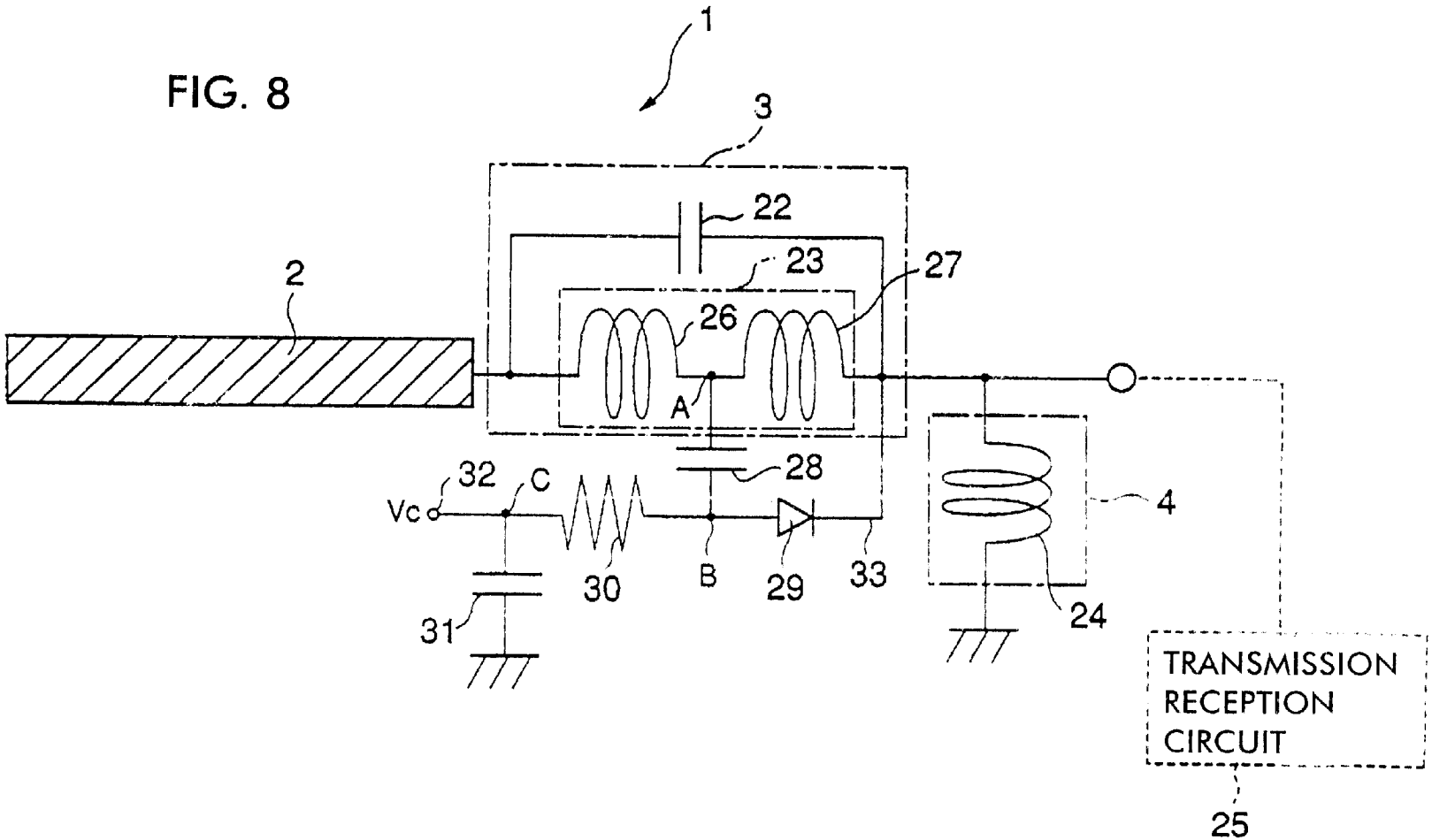
Figure 9:
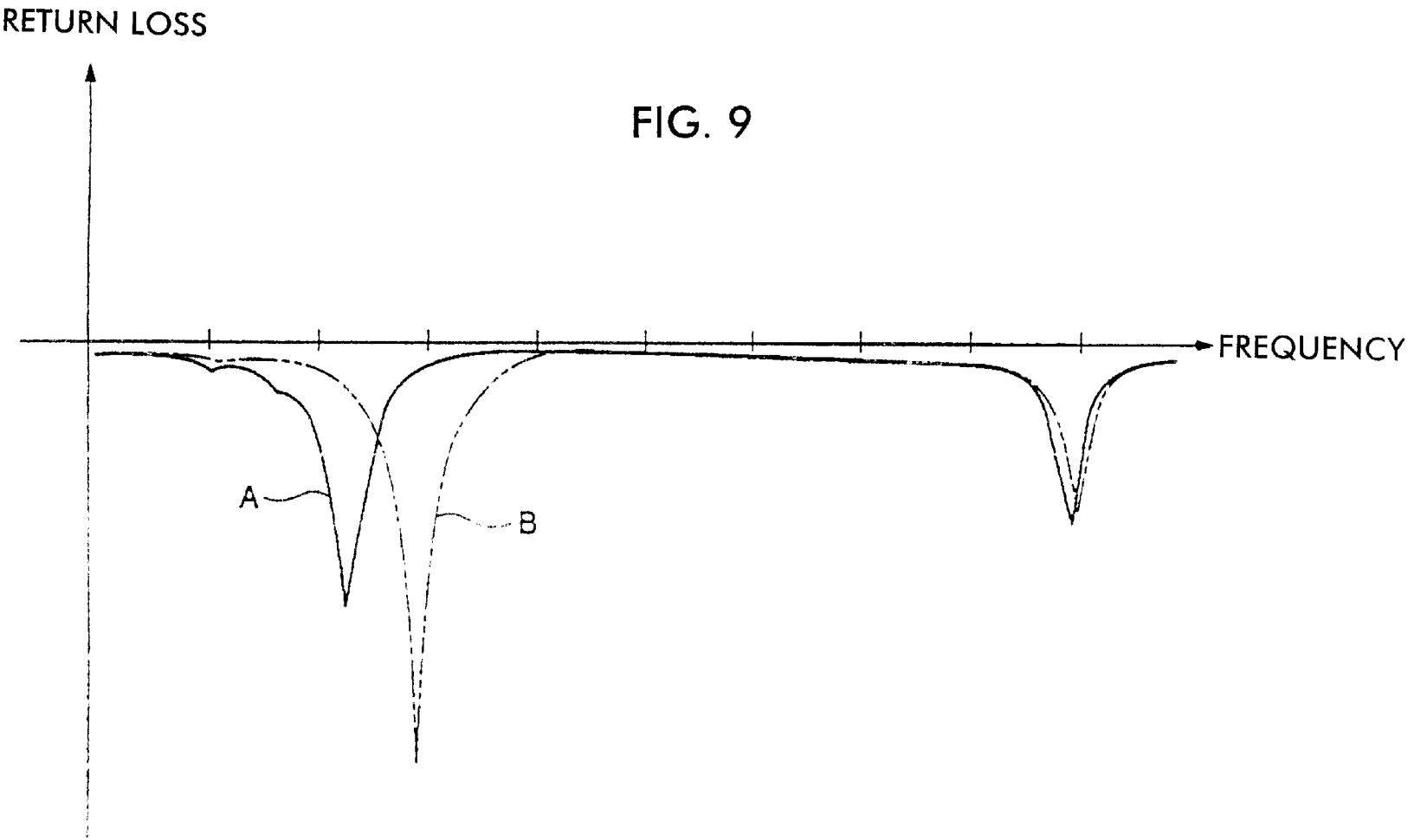
Figure 10:
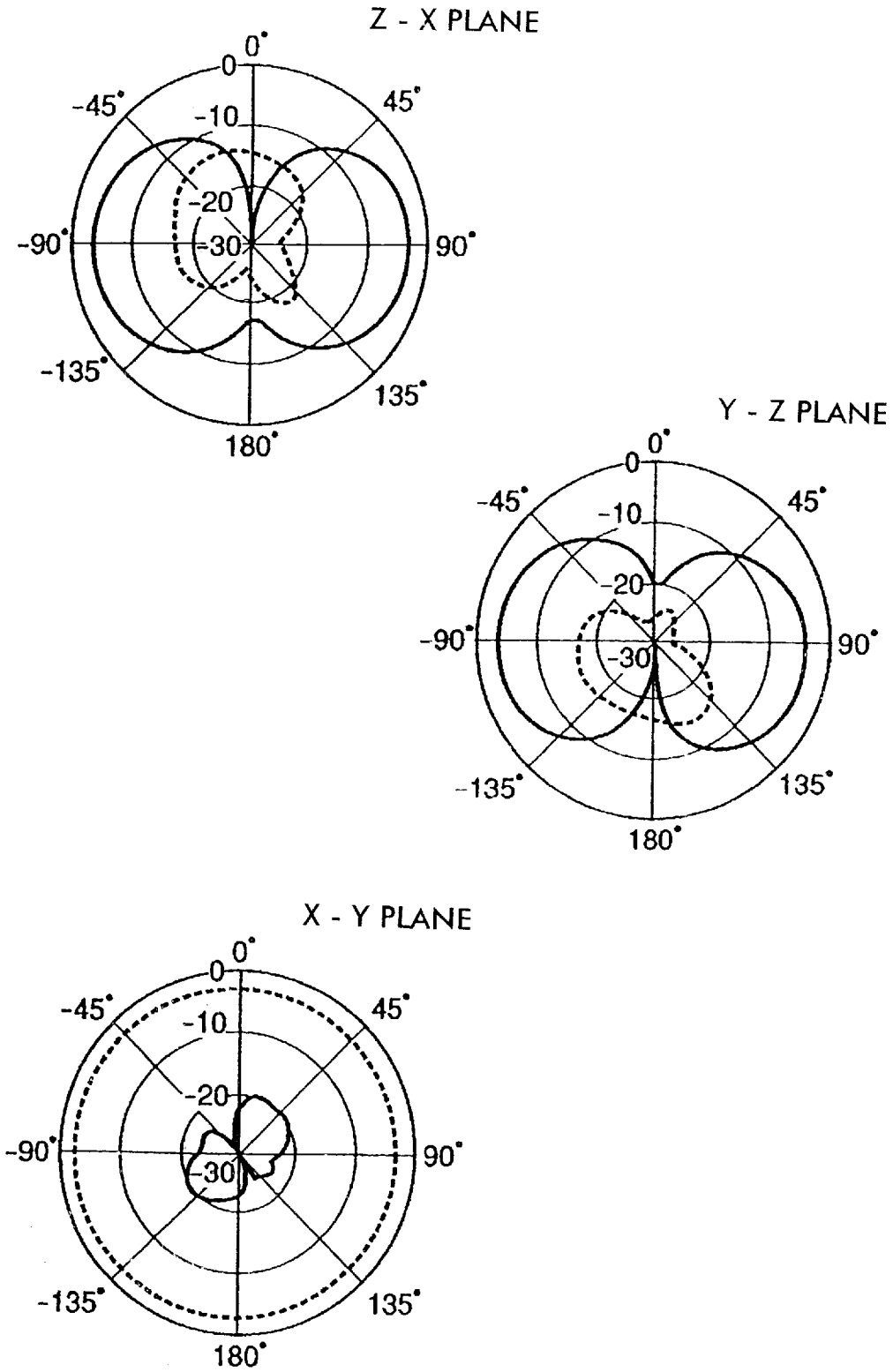
Figure 11:
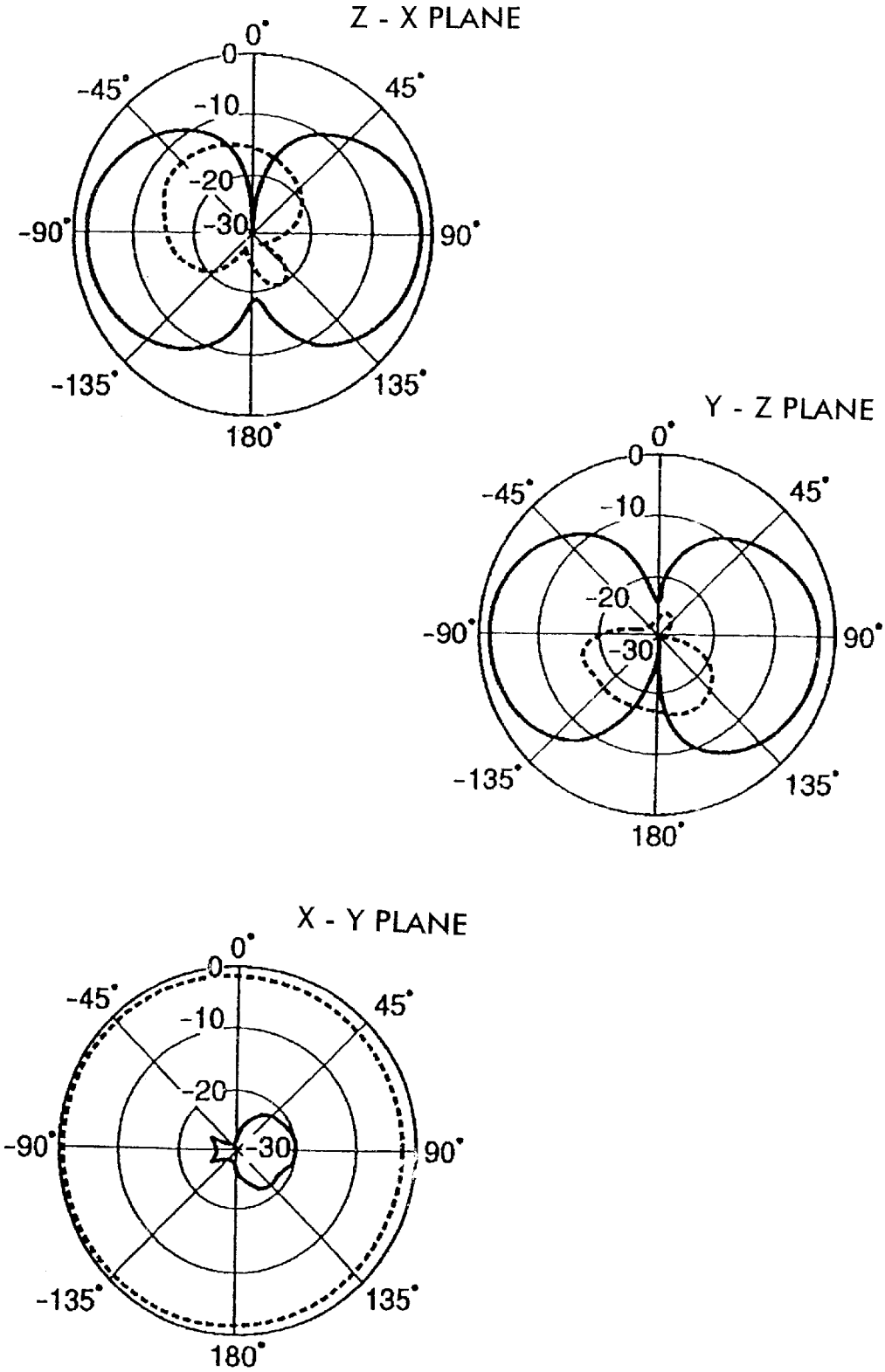
Figure 12:
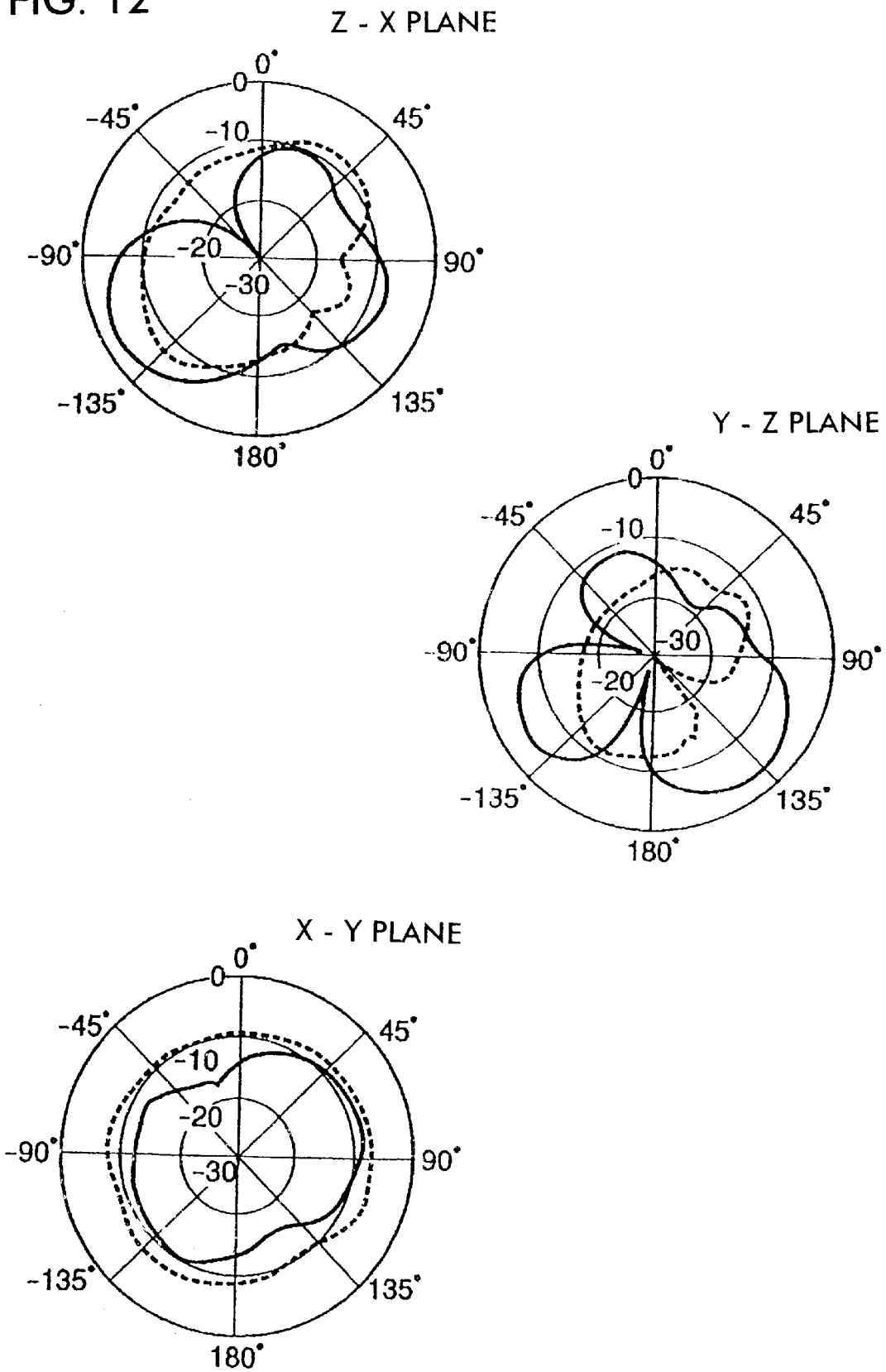
Figure 13A:
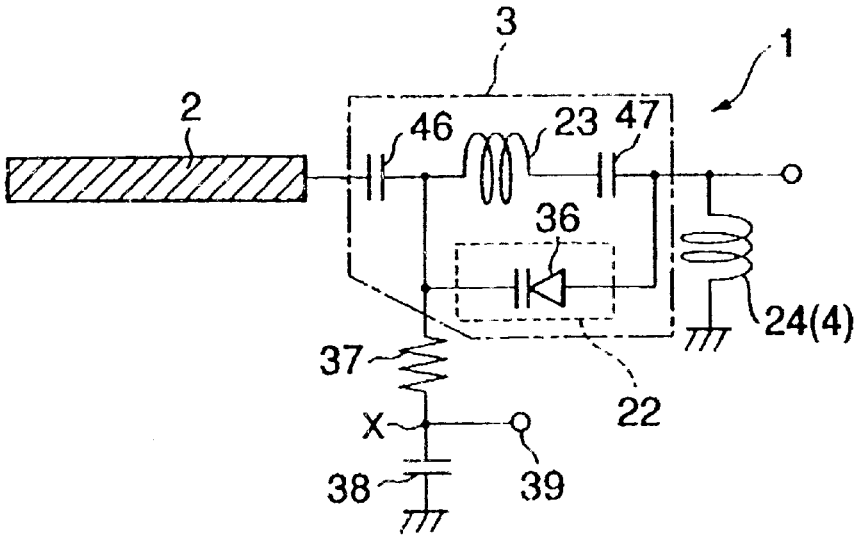
Figure 13B:
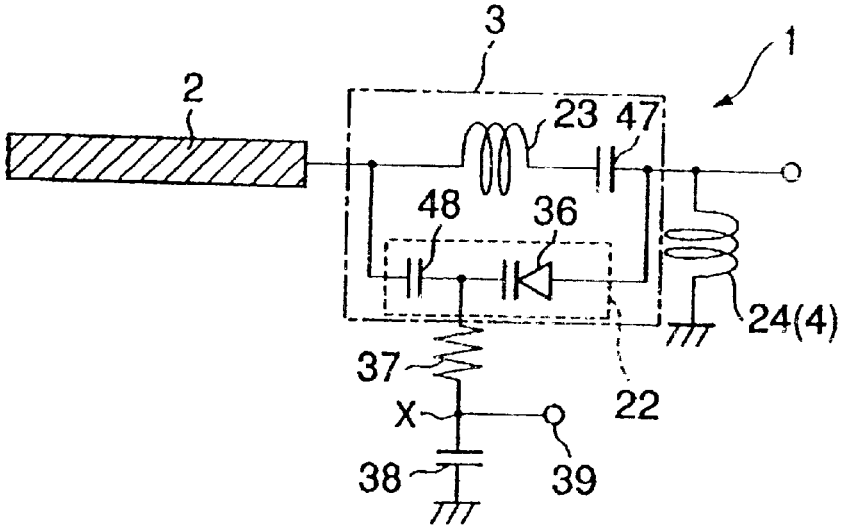
Figure 14A:
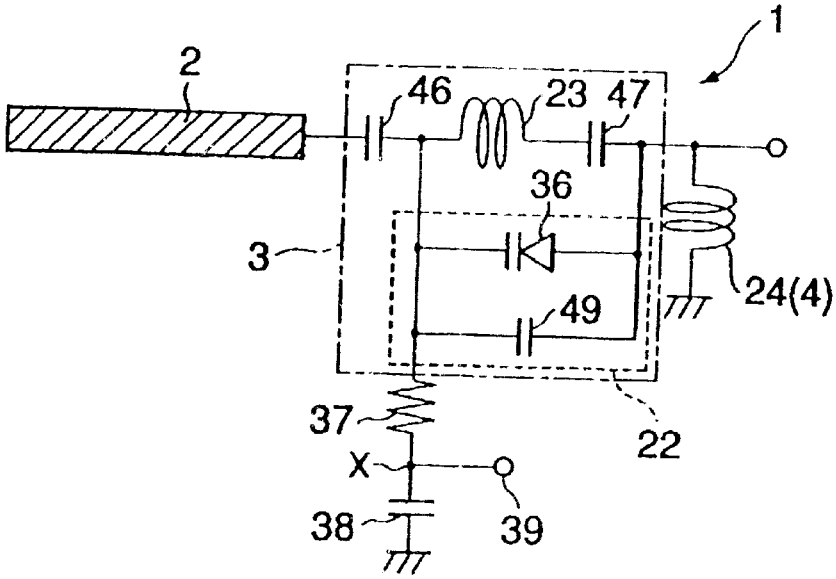
Figure 14B:
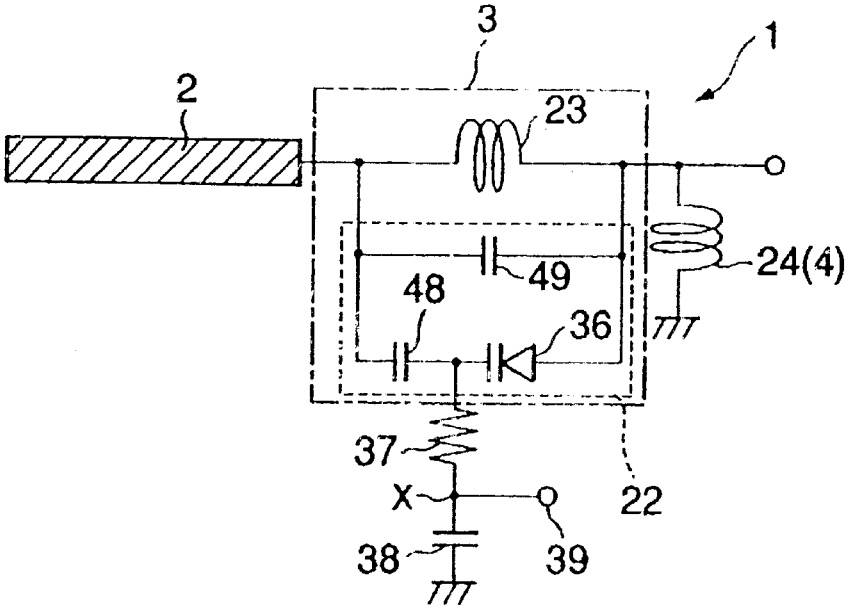
Figure 15:
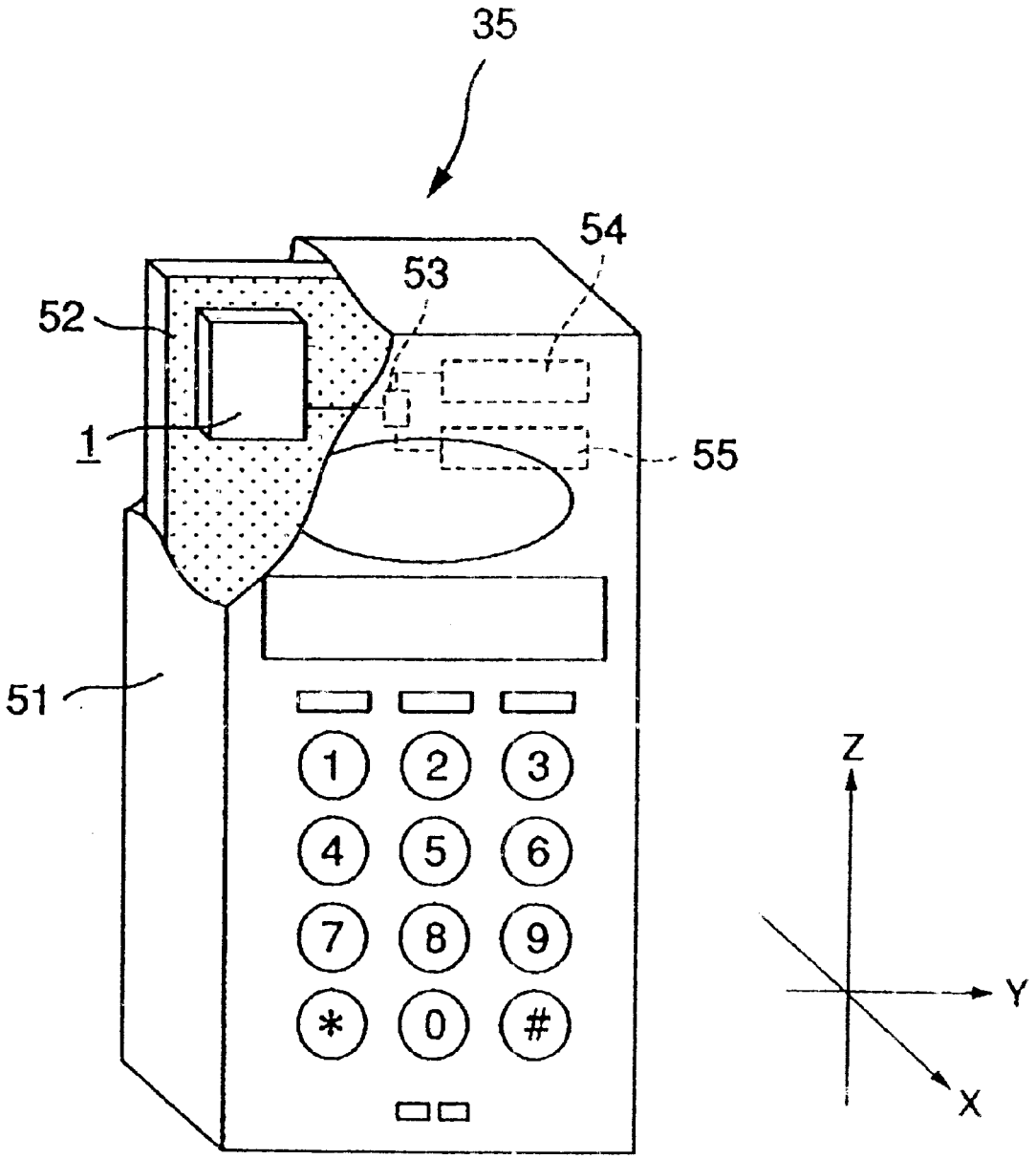
Figure 16:
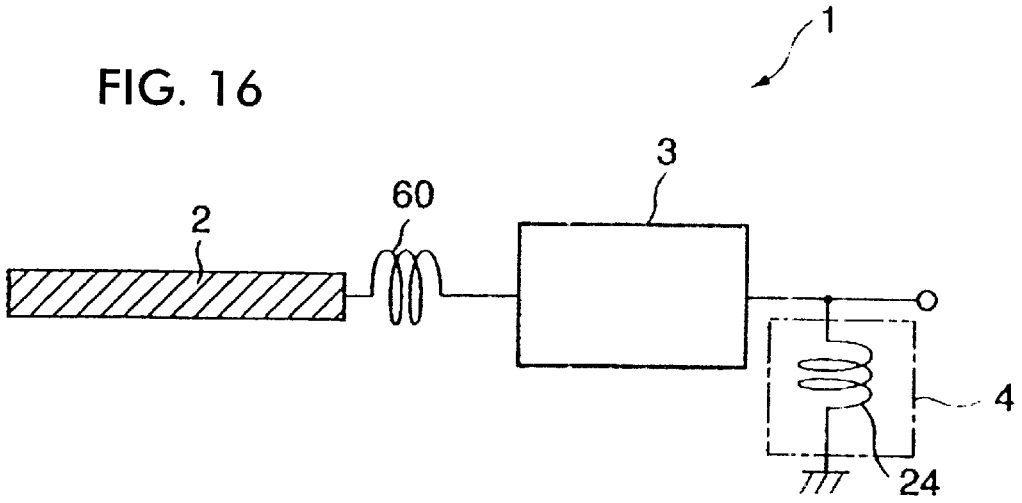
Figure 17:
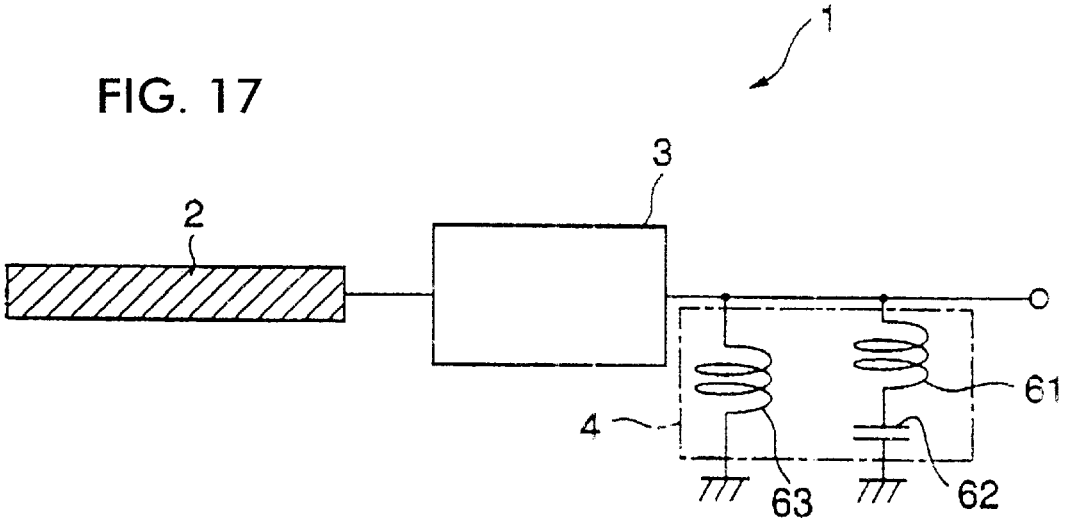
Figure 18:
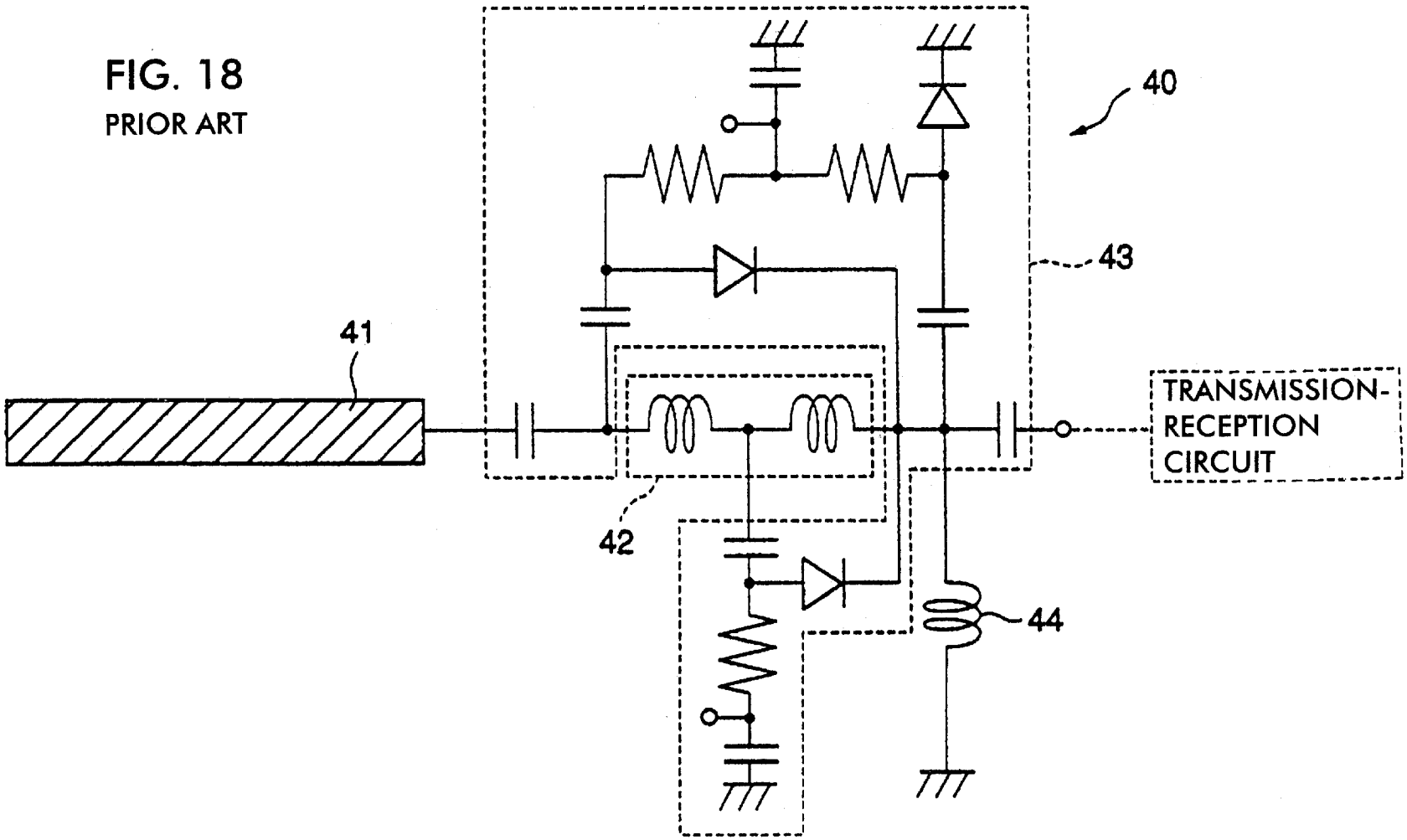
FIG. 18 PRIOR ART

FIG. 8 schematically shows the characteristic configuration of an antenna device according to a second embodiment of the present invention;

FIG. 9 is a graph showing an example of the frequency characteristic of an antenna conductor portion of the second embodiment;

FIG. 10 graphically shows the directivities in the digital band of PDC800 MHz, obtained by the experiment of the antenna device having the characteristic configuration according to the second embodiment;

FIG. 11 graphically shows the directivities in the analog band of PDC800 MHz, obtained by the experiment of the antenna device having the characteristic configuration according to the second embodiment;

FIG. 12 graphically shows the directivities in the PDC1.5 GHz band, obtained by the experiment of the antenna device having the characteristic configuration according to the second embodiment;

FIG. 13A illustrates an example of the circuit configuration of the capacitor portion of an LC parallel resonance circuit provided with a varicap diode;

FIG. 13B illustrates another example of the circuit configuration of the capacitor portion of the LC parallel resonance circuit provided with the varicap diode;

FIG. 14A illustrates yet another example of the circuit configuration of the capacitor portion of the LC parallel resonance circuit provided with the varicap diode;

FIG. 14B illustrates still another example of the circuit configuration of the capacitor portion of the LC parallel resonance circuit provided with the varicap diode;

FIG. 15 illustrates an example of radio equipment according to the present invention;

FIG. 16 illustrates another embodiment of the present invention;

FIG. 17 illustrates an example of a matching circuit and so forth according to the present invention; and FIG. 18 illustrates an example of a conventional antenna device.

DETAILED DESCRIPTION OF EMBODIMENTS OF THE INVENTION

Hereinafter, embodiments of the present invention will be described with reference to the drawings.

Figure 1:
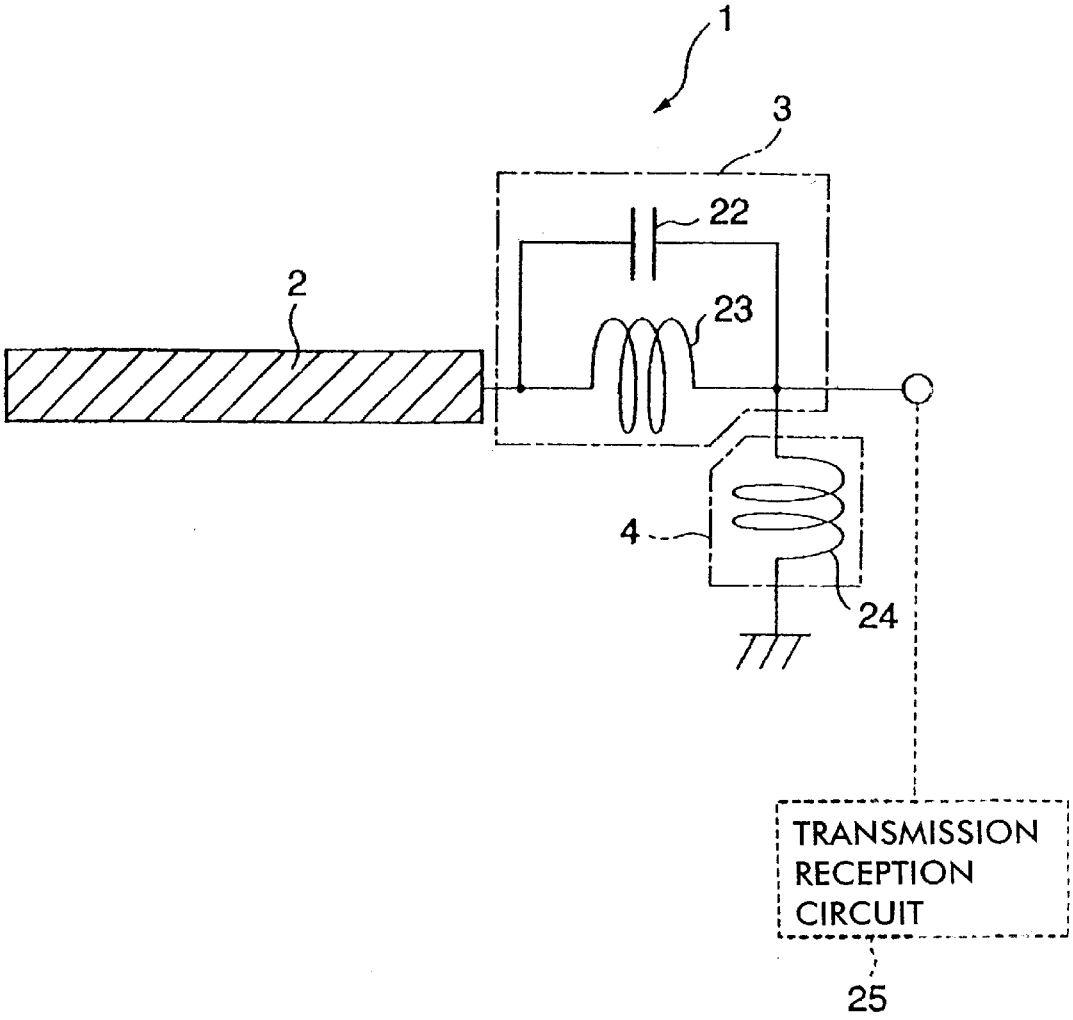

FIG. 1 schematically shows a first embodiment of the antenna device of the present invention. The antenna device 1 of the first embodiment is a dual band type in which transmission-reception in two different frequency bands (e.g., 800 MHz band and 1.5 GHz band) can be carried out. The antenna device 1 comprises an antenna conductor portion 2, an LC parallel resonance circuit 3, and a matching circuit 4, and is contained in radio equipment such as a portable telephone or the like.

The antenna conductor portion 2 is made of a conductor material, and operates to transmit and receive radio waves. Different forms of the antenna conductor portion 2 are available. Any one of a plurality of the forms of the antenna conductor portion 2 may be employed in the first embodiment. FIGS. 4A to 7B show examples of the forms, respectively.

Figure 4A:
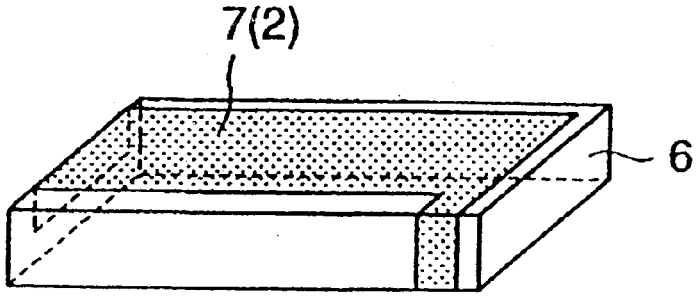
FIG. 4A illustrates an example of the form of the antenna conductor portion.
Figure 4B:
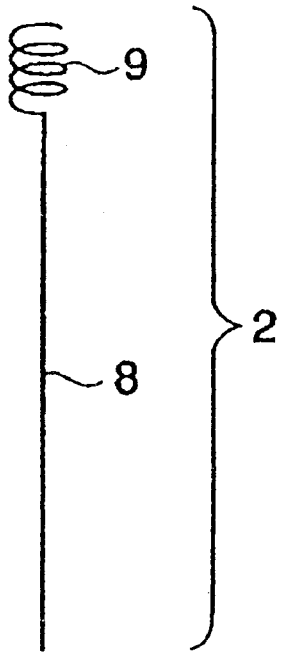
FIG. 4B illustrates another example of the form of the antenna conductor portion.

In the example of FIG. 4A, the antenna conductor portion 2 comprises a conductor film (conductor portion) 7 for transmission-reception of radio waves, which is formed on the surface of a substrate 6 made of a dielectric or magnetic material. In the example of FIG. 4B, the antenna conductor portion 2 is formed of a conductor wire which comprises a conductor wire member of a helical antenna portion 9 provided in the top of a whip antenna portion 8. In the example of FIG. 4B, the antenna conductor portion 2 comprises a combination of the whip antenna portion 8 with the helical antenna portion 9 connected to each other, as described above. The antenna conductor portion 2 may comprise the whip antenna portion 8 only. Alternatively, the antenna conductor portion 2 may comprise the helical antenna portion 9 only as a conductor wire.

Figure 5A:
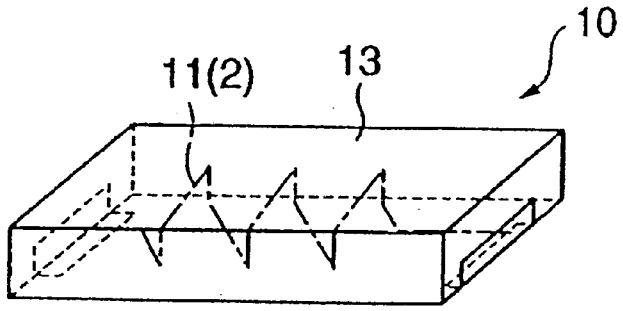
FIG. 5A illustrates yet another example of the form of the antenna conductor portion.

In the example of FIG. 5A, the antenna conductor portion 2 comprises a conductor portion 11 for wave transmission-reception of radio waves, which constitutes a chip multi-layer antenna 10. The chip multi-layer antenna 10 contains a substrate 13 which comprises plural sheet substrates 12*a,*

Figure 5B:
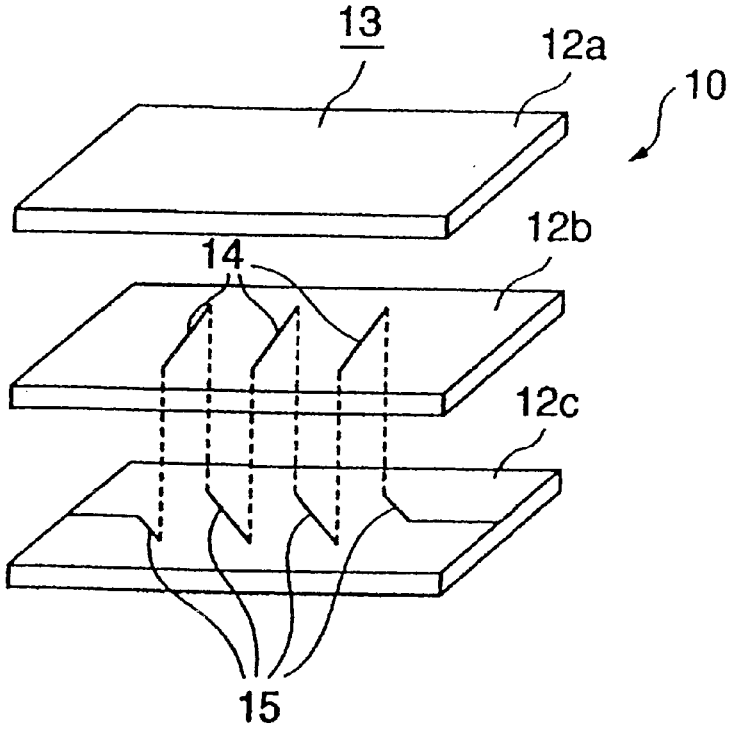
Fig. 5B is an assembly diagram of the antenna conductor portion.

12*b*, and 12*c* laminated and integrated together as shown in FIG. 5B (three sheet substrates in the example of FIG. 5B), and the conductor portion 11 for transmission-reception of radio waves formed on the substrate 13. Conductor patterns 14 and 15 are formed on the upper sides of the sheet substrates 12*b* and 12*c*, respectively, in the example of FIGS. 5A and 5B. When the sheet substrates 12*a*, 12*b*, and 12*c* are laminated and integrated with each other, the conductor patterns 14 on the sheet substrates 12*b* and the conductor pattern 15 on the sheet substrates 12*c* are electrically connected to each other through via-holes to form the spiral conductor portion 11. Thus, the chip multi-layer antenna 10 has the conductor portion 11 formed inside the substrate 13

Figure 6A:
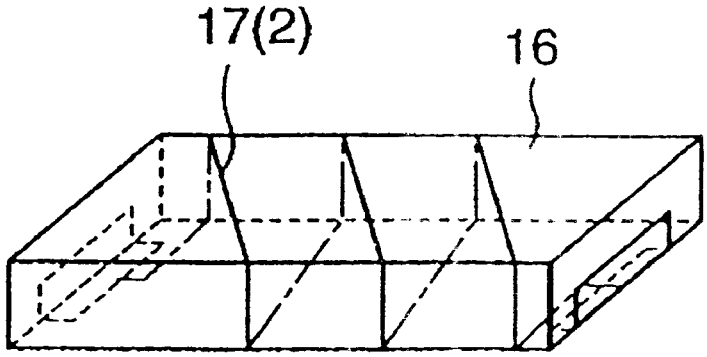
FIG. 6A illustrates still another example of the form of the antenna conductor portion.
Figure 6B:
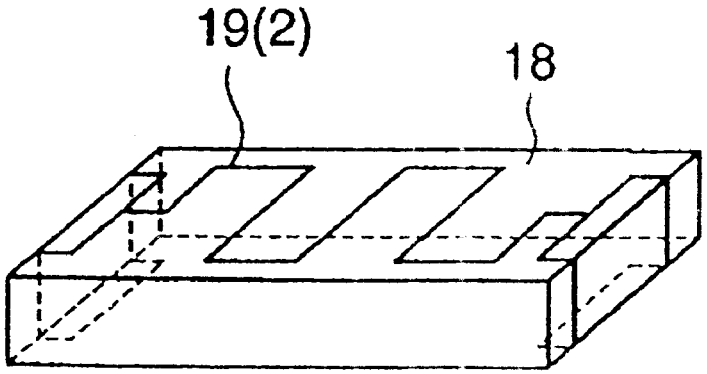
FIG. 6B illustrates another example of the form of the antenna conductor portion.

Referring to the example of FIG. 6A, the antenna conductor portion 2 comprises a spiral conductor portion 17 for radio-wave transmission-reception which is formed on the surface of a substrate 16 made of a dielectric, a magnetic material, or the like. Moreover, in the example of FIG. 6B, the antenna conductor portion 2 comprises a meander-shaped conductor portion 19 for radio-wave transmission-reception which is formed on the surface of a substrate 16 made of a dielectric, a magnetic material, or the like.

In the example of FIG. 7A, the antenna conductor portion 2 comprises a combination of a conductor portion 7 shown in FIG. 4A with a conductor sheet member 20 electrically connected to each other. The antenna conductor portion 2 may comprise a combination of one of the conductor portions 11, 17, and 19 shown in FIGS. 5A, 6A, and 6B, respectively, with the conductor sheet member 20 shown in FIG. 7A electrically connected to each other. The antenna conductor portion 2 may comprise the conductor sheet member only.

In the example of FIG. 7B, the antenna conductor portion 2 comprises a combination of the conductor wire member of the whip antenna portion 8 and the helical antenna portion 9 connected to each other, with one of the conductor portions 6, 13, 16, and 18 shown in FIGS. 4A, 5A, 6A, and 6B. which are electrically connected to each other. The antenna conductor portion 2 may comprise a combination of the whip antenna portion 8 or helical antenna portion 9, with the conductor portion electrically connected to each other.

For the antenna conductor portion 2, various forms are available, as described above. The antenna conductor portion 2 may have any one of the above-described various forms and other appropriate forms.

Figure 2:
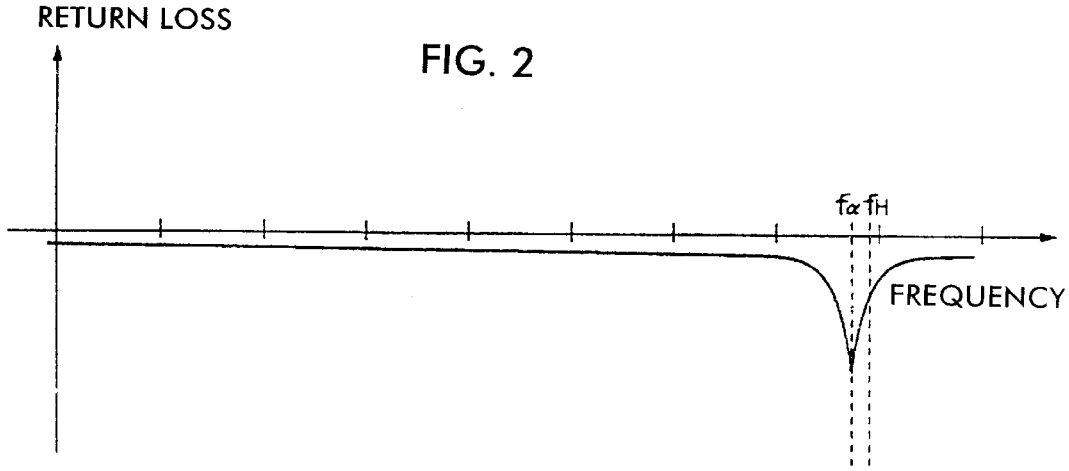
FIG. 2 is a graph showing an example of the frequency characteristic of an antenna conductor portion, obtained when no LC parallel resonance circuit is connected.

In the first embodiment, the antenna conductor portion 2 is formed so as to have an electrical length which is equal to about one fourth of the wavelength of a radio wave having a set center frequency $f_H$ in the higher frequency band, whereby the resonance frequency of the antenna conductor portion 2 itself becomes equal to the frequency fα in the frequency characteristic shown in FIG. 2 (the frequency fα is slightly lower than the center frequency $f_H$ in the higher frequency band of the two frequency bands for radio-wave transmission-reception previously set).

The LC parallel resonance circuit 3 is connected to the power supply side of the antenna conductor portion 2 as shown in FIG. 1.

The LC parallel resonance circuit has peculiar impedance characteristics.

That is, the LC parallel resonance circuit presents a capacitive impedance characteristic in a frequency range higher than the resonance frequency fβ of the circuit, and also, presents an inductive impedance characteristic in a frequency range lower than the resonance frequency fβ. Especially, the LC parallel resonance circuit has large inductance at a frequency slightly lower than the resonance frequency fβ of the circuit. Therefore, the LC resonance circuit 3, when the circuit 3 is connected in series with the power supply side of the antenna conductor portion 2 as described in the first embodiment, can render to the antenna conductor portion 2 a large inductance for causing the antenna conductor portion 2 to resonate at a frequency slightly lower than the resonance frequency fβ.

When the LC parallel resonance circuit 3 operates in a frequency range higher than the resonance frequency fβ, it is equivalent to the state in which a capacitor is connected to the power supply side of the antenna conductor portion 2. When the capacitance is connected to the power supply side of the antenna conductor portion 2, as described above, the inductance of the antenna conductor portion 2 decreases correspondingly to the capacitance of the capacitor. Thus, the antenna conductor portion 2 resonates at a frequency higher than the resonance frequency fα of the antenna conductor portion 2 itself.

In the first embodiment, the circuit constants of the LC parallel resonance circuit 3 are set so as to satisfy the following conditions, considering the above-described characteristics of the LC parallel resonance circuit. In particular, the circuit constants of the LC parallel resonance circuit 3 are predetermined by operation or the like, so that the circuit 3 can render, to the power supply side of the antenna conductor portion 2, a capacitance for causing the antenna conductor portion 2 to resonate at the center frequency $f_H$ in the higher frequency band, and can resonate at the frequency fβ slightly higher than the center frequency $f_L$ in the lower frequency band as described above (the circuit constants includes the capacitance C of the capacitor portion 22, and the inductance L of the inductor portion 23, said portions 22 and 23 constituting the LC parallel resonance circuit).

Figure 3:
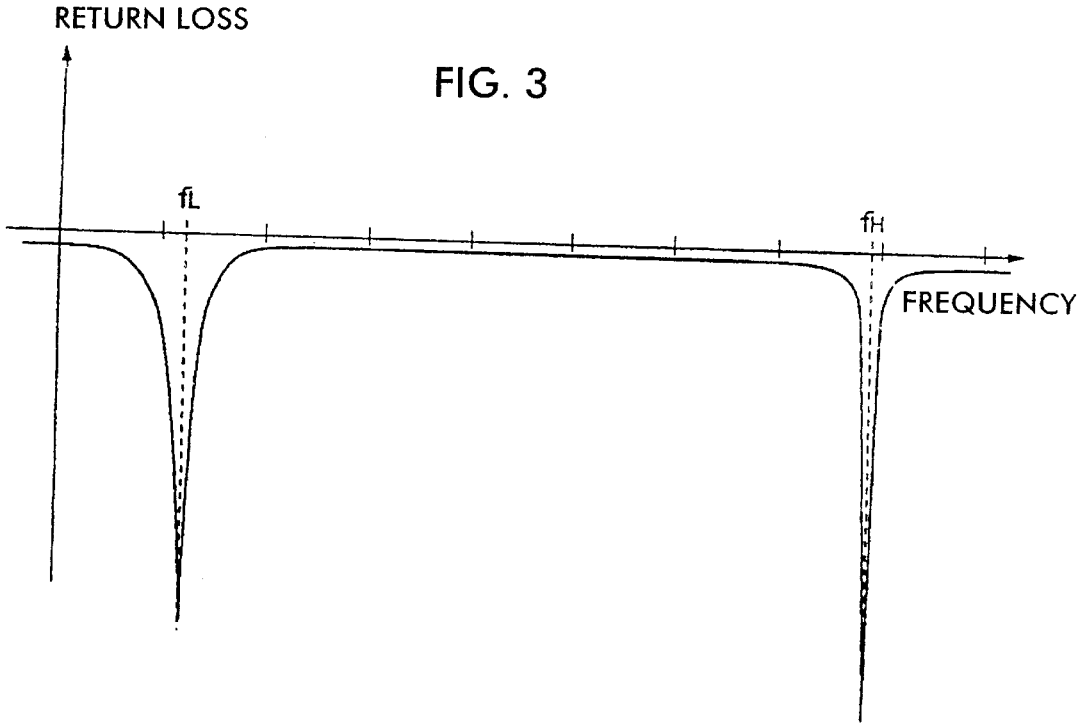
FIG. 3 is a graph showing an example of the frequency characteristic of an antenna conductor portion, obtained when an LC parallel resonance circuit is connected.

When the LC parallel resonance circuit 3, designed as described above, is connected in series with the power supply side of the antenna conductor portion 2, the antenna conductor portion 2 can resonate at the center frequency $f_L$ in the lower frequency band and also, at the center frequency $f_H$ in the higher frequency band, as shown in the frequency characteristic of FIG. 3, so that the portion 2 can operate as an antenna.

In the first embodiment, the matching circuit 4 comprises an inductor 24 as shown in FIG. 1. The inductor 24 is connected between the LC parallel resonance circuit 3 and ground, and has an inductance at which the impedances in the higher and lower frequency bands can be matched to each other.

The antenna device 1 of the first embodiment is configured as described above. The antenna device 1 is attached to radio equipment such as a portable telephone or the like, and with the operation of a transmission-reception circuit 25, the antenna conductor portion 2 operates as an antenna to transmit and receive radio waves.

In the first embodiment, the antenna device 1 has the configuration in which the LC parallel resonance circuit 3 is connected in series with the power supply side of the antenna conductor portion 2, whereby radio waves in the two different frequency bands previously set can be transmitted and received. Thus, the transmission-reception of radio waves in the two different frequency bands is enabled by the simple configuration in which the LC parallel resonance circuit 3 is connected in series with the power supply side of the antenna conductor portion 2 without complicated circuits for changing the lower and higher frequency bands for transmitting and receiving radio waves being provided.

Conventionally, a complicated circuit for changing the lower and higher frequency bands is provided. This causes problems in that the antenna sensitivity deteriorates due to the increased conduction loss, and the high production cost of the change-over circuit increases the cost of the antenna device 1. On the other hand, in the first embodiment, the change-over circuit for changing the higher and lower frequency bands is not needed as described above. Accordingly, the above-described problems, caused by the change-over circuit, can be eliminated. Moreover, the antenna device 1 can be miniaturized, since no complicated change-over circuit is required.

Accordingly, in the first embodiment, the above-described especial configuration can provide an antenna device 1 which can transmit and receive radio-waves in two different frequency bands at high sensitivity, and moreover, is inexpensive and small in size.

Hereinafter, a second embodiment of the present invention will be described. Characteristically, in the second embodiment, the antenna device 1 is configured so that the lower frequency band for transmitting and receiving a radio-wave can be varied and set, in addition to the above-described configuration of the first embodiment. The configuration of the antenna device 1 of the second embodiment is the same as that of the first embodiment, except for the peculiar configuration in which the lower frequency band can be varied and set. In the description of the second embodiment, similar parts to those of the first embodiment are designated by the same reference numerals, and the repeated description is omitted.

In the second embodiment, the inductor portion 23 constituting the LC parallel resonance circuit 3 comprises two inductors 26 and 27 connected in series with each other, as shown in FIG. 8. One end of a capacitor 28 is connected to the node A between the inductors 26 and 27. The other end of the capacitor 28 is connected to the anode side of a PIN diode 29. The cathode side 29 of the PIN diode 29 is connected to the power supply side of the inductor 27.

Moreover, one side of a resistor 30 is connected to the node B between the capacitor 28 and the PIN diode 29. A capacitor 31 is incorporated between the other side of the resistor 30 and ground. A voltage input portion 32 is electrically connected to the node C between the resistor 30 and the capacitor 31.

Referring to the properties of the PIN diode, the resistance to an AC signal varies correspondingly to DC current flowing through the PIN diode. When no DC current flows through the PIN diode, the resistance to an AC signal becomes very large, so that the AC signal can scarcely been transmitted. Moreover, the resistance to an AC signal becomes substantially zero when DC current flows in the zero-resistance current range which can be predetermined for each PIN diode.

In the second embodiment, a supply (not shown) of voltage Vc, which causes the DC current in the zero-voltage current range to flow through the PIN diode 29, is connected to the voltage input portion 32. When the voltage Vc from the voltage supply is input via the voltage input portion 32, the resistance of the PIN diode 29 to an AC signal becomes substantially zero. Thus, the AC signal, not transmitted through the inductor 27, is fed through a path from the node A between the inductors 26 and 27 via the capacitor 28 and the PIN diode 29 toward the power supply side of the inductor 27. In other words, in the second embodiment, a bypass conduction path 33 comprises a conduction path ranging from the node A between the inductors 26 and 27 via the capacitor 28 and the PIN diode 29 toward the power supply side of the inductor 27.

As described above, the inductance of the inductor portion 23 becomes nearly equal to the inductance La of the inductor 26, when an AC signal is applied through the bypass conduction path 33, not through the inductor 27.

When no voltage is input via the voltage input portion 23, the resistance of the PIN diode 29 to AC signals becomes very large, so that the most of the AC signals are transmitted through the inductor 27, not through the bypass conduction path 33. Accordingly, the inductance of the inductor portion 23 can be expressed as the sum (La+Lb) of the inductance La of the inductor 26 and the inductance Lb of the inductor 27.

As described above, in the second embodiment, the PIN diode 29 constitutes a switching portion for on-off control of the conduction of the bypass conduction path. The on-off control of the conduction of the bypass conduction path 33 is controlled by the on-off operation of the PIN diode 29, so that the inductance of the inductor portion 23 is changed. That is, the PIN diode 29 and the bypass conduction path 33 constitute a switch-over circuit for changing the inductance of the inductor portion 23.

For example, when the above-described control for changing the inductance of the inductor portion 23 causes the inductance of the inductor portion 23 to change so as to decrease from the sum (La+Lb) of the respective inductances of the inductors 26 and 27 toward the inductance La of the inductor 26 only, the resonance frequency of the LC parallel resonance circuit 3 is changed. Thus, the frequency characteristic of the antenna conductor portion 2 is changed. That is, the frequency characteristic shown by solid line A in FIG. 9 of the antenna conductor portion 2 is changed to that shown by chain line B in FIG. 9. Thus, the center frequency in the lower frequency band is changed so as to increase.

Accordingly, in the case in which the antenna device 1 is desired to operate in two frequency bands, that is, in the frequency band of 810 to 843 MHz which is a digital band of PDC800 MHz, and in the frequency band of 870 to 885 MHz which is an analog band of PDC800 MHz, the inductances La and Lb of the respective inductors 26 and 27 are set so that the sum (La+Lb) of the inductances La and Lb of the inductors 26 and 27 has a value at which transmission-reception of a radio wave in the digital band of PDC 800 MHz is possible, and the inductance La of the inductor 26 has a value at which transmission-reception of a radio wave in the analog band of PDC 800 MHz is possible.

When the inductances La and Lb of the inductors 26 and 27 are set as described above, the antenna device 1 of the second embodiment can be mounted onto radio equipment which can transmit and receive radio waves, e.g., in a PDC1.5 GHz band and the digital band of PDC800 MHz, or radio equipment which can transmit and receive radio waves, e.g., in the PDC1.5 GHz band and the analog band of PDC 800 MHz In the second embodiment, the circuit for changing the inductance of the inductor portion 23 is provided, in addition to the configuration of the first embodiment. Thus, the advantages described in the first embodiment can be obtained. In addition, the inductance of the inductor portion 23 can be changed and controlled by the change-over circuit so that the lower frequency band for transmitting and receiving radio waves can be varied and set. Thereby, the antenna device 1 can be mounted onto plural types of radio equipment which can operate in different lower frequency bands.

Conventionally, the circuit 43 for changing the inductance of the inductor portion 42 is provided as shown in FIG. 18. The change-over circuit 43 changes the inductance of the inductor portion 42 so that the higher and lower frequency bands can be changed. Accordingly, the inductance of the inductor portion 42 is required to be significantly changed. Thus, the change-over circuit 43 cannot avoid having a complicated circuit configuration as shown in FIG. 18.

On the other hand, in the change-over circuit shown in the second embodiment, the inductance of the inductor portion 23 is changed to a small degree. Thus, the circuit configuration may be very simple as shown in FIG. 8.

Moreover, in the second embodiment, the PIN diode 29 is used as the switching portion of the change-over circuit. The PIN diode 29 is arranged so that the anode thereof is directed to the antenna conductor portion 2 side. Thus, the antenna device 1 of the second embodiment is mainly used as a reception antenna. This is because, when a large AC signal for transmission is input to the PIN diode, a higher harmonic is generated, due to the non-linear characteristics of the PIN diode. However, in some cases, generation of such a high harmonic can be suppressed in low output radio equipment. In this case, the antenna device 1 of the second embodiment may be mounted as a transmission antenna to the low output radio equipment.

The inventors carried out an experiment in which the antenna device 1 having a peculiar configuration according to the second embodiment was prepared, and the performance of the antenna device 1 was examined. This experiment was made assuming that the antenna device 1 would be contained in a portable telephone 35 (FIG. 15). The antenna device 1 used in this experiment was configured so that it could transmit and receive radio waves while the analog band of PDC 800 MHz and the digital band were changed, and moreover, transmission and reception of radio waves in the PDC 1.5 GHz band was possible. The inventors investigated the antenna directivities of the antenna device 1, produced as described above, in the Z-X plane, the Y-Z plane, and X-Y plane shown in FIG. 15. FIGS. 10 to 12 and Table 1 to 3 shown the data on the antenna directivities obtained in this experiment.

FIG. 10 shows the antenna directivities at a frequency of 826.5 MHz which is in the digital band (810 to 843 MHz) of PDC800 MHz. FIG. 11 shows the antenna directivities at a frequency of 877.5 MHz which is in the analog band (870 to 885 MHz) of PDC800 MHz. FIG. 12 shows the antenna directivities at a frequency of 1489 MHz which is in the PDC1.5 GHz band. In FIGS. 10 to 12, the dotted lines represent the directivities of vertically polarized waves, respectively. In FIGS. 10 to 12, the solid lines represent the directivities of horizontally polarized waves. Table 1 lists the directivities in the digital band of PDC800 MHz. Table 2 lists the directivities in the analog band of PDC800 MHz. Table 3 lists the directivities in the PDC1.5 GHz band.

TABLE 1

| | | Z-X plane | | Y-Z plane | | X-Y plane | |
|---|---|---|---|---|---|---|---|
| Frequency (MHz) | | vertical polarized wave | horizontal polarized wave | vertical polarized wave | horizontal polarized wave | vertical polarized wave | horizontal polarized wave |
| 810 | peak value (dBd) | −14.3 | −3.9 | −16.3 | −3.6 | −2.7 | −19.1 |
| | average (dBd) | −18.1 | −7.3 | −19.5 | −7.4 | −4.0 | −22.2 |
| 826.5 | peak value (dBd) | −13.6 | −3.2 | −15.1 | −3.0 | −1.8 | −19.3 |
| | average (dBd) | −17.6 | −6.5 | −19.2 | −6.6 | −2.9 | −22.2 |
| 843 | peak value (dBd) | −14.3 | −3.7 | −15.4 | −3.3 | −2.2 | −20.3 |
| | average (dBd) | −18.2 | −6.9 | −20.1 | −7.0 | −3.3 | −23.7 |

TABLE 2

| | | Z-X plane | | Y-Z plane | | X-Y plane | |
|---|---|---|---|---|---|---|---|
| Frequency (MHz) | | vertical polarized wave | horizontal polarized wave | vertical polarized wave | horizontal polarized wave | vertical polarized wave | horizontal polarized wave |
| 870 | peak value (dBd) | −13.5 | −2.4 | −15.2 | −2.2 | −0.8 | −20.1 |
| | average (dBd) | −17.8 | −5.7 | −20.4 | −5.7 | −1.7 | −24.6 |
| 877.5 | peak value (dBd) | −13.3 | −1.9 | −15.2 | −1.7 | −0.4 | −19.9 |
| | average (dBd) | −17.7 | −5.3 | −20.3 | −5.3 | −1.3 | −24.5 |

TABLE 2-continued

| Frequency (MHz) | | Z-X plane | | Y-Z plane | | X-Y plane | |
|---|---|---|---|---|---|---|---|
| | | vertical polarized wave | horizontal polarized wave | vertical polarized wave | horizontal polarized wave | vertical polarized wave | horizontal polarized wave |
| 885 | peak value (dBd) | −13.0 | −1.3 | −15.3 | −1.1 | 0.0 | −19.5 |
| | average (dBd) | −17.6 | −4.8 | −20.2 | −4.8 | −0.9 | −24.1 |

TABLE 3

| Frequency (MHz) | | Z-X plane | | Y-Z plane | | "X-Y plane | |
|---|---|---|---|---|---|---|---|
| | | vertical polarized wave | horizontal polarized wave | vertical polarized wave | horizontal polarized wave | vertical polarized wave | horizontal polarized wave |
| 1477 | peak value (dBd) | −7.8 | −3.4 | −13.0 | −3.8 | −6.8 | −9.3 |
| | average (dBd) | −11.3 | −9.0 | −15.9 | −9.0 | −8.5 | −12.6 |
| 1489 | peak value (dBd) | −7.2 | −2.8 | −12.0 | −3.3 | −6.4 | −8.1 |
| | average (dBd) | −10.7 | −8.5 | −15.0 | −8.6 | −8.2 | −11.5 |
| 1501 | peak value (dBd) | −9.1 | −4.7 | −13.4 | −5.2 | −8.7 | −9.2 |
| | average (dBd) | −12.5 | −10.4 | −16.3 | −10.7 | −10.4 | −12.9 |

The above-described experimental results were compared with the performances of antennas operating in the 800 MHz band and in the 1.5 GHz band which are used as products. As a result, it has been found that high gains comparable to those of the performances of the respective products can be obtained. Thus, it has been identified that the antenna device 1 having the configuration characteristic of the second embodiment can be satisfactorily used in practice.

Hereinafter, a third embodiment of the present invention will be described. Characteristically, in the third embodiment, the capacitor portion 22 of the LC parallel resonance circuit 3 is configured so as to have a varicap diode, so that the capacitance of the capacitor portion 22 can be easily changed. The other configurations are similar to those of the above-described respective embodiments. In the description of the third embodiment, similar parts to those of the above-described embodiments are designated by the same reference numerals, and the repeated description is omitted.

In the third embodiment, characteristically, the capacitor portion 22 contains a varicap diode. Regarding the varicap diode, the parasitic capacitance continuously varies correspondingly to applied voltage. Accordingly, the capacitance C of the capacitor portion 22 can be easily varied by changing the voltage applied to the varicap diode. Therefore, the resonance frequency of the LC parallel resonance circuit 3 is varied only by changing the voltage applied to the varicap diode. Thus, the lower frequency band for transmitting and receiving radio waves can be varied and set correspondingly to the specifications of the antenna device 1. Needless to say, the higher frequency band can be also varied and set.

For the capacitor portion 22 having the varicap diode, various circuit configurations can be provided. For example, the capacitor portion 22 comprises a single varicap diode 36 in the example of FIG. 13A. A resistor 37 and a capacitor 38 connected in series with each other are connected to the cathode side of the varicap diode 36. A voltage input portion 39 is electrically connected to the node X between the resistor 37 and the capacitor 38.

A voltage supply (not shown) is electrically connected to the voltage input portion 39. The voltage supply is configured so that a voltage at which the parasitic capacitance of the varicap diode 36 has a desired value (that is, the value at which transmission-reception of radio waves in the lower and higher frequency bands in compliance with the specifications thereof or the like is possible) can be input via the voltage input portion 39.

A capacitor 46 shown in FIG. 13A prevents the voltage, which is supplied via the voltage input portion 39, from exerting hazardous influences over the antenna conductor portion 2. A capacitor 47 prevents the voltage, which is supplied via the voltage input portion 39, from being applied to the varicap diode 36 by short-circuiting due to the inductor 23.

In the example of FIG. 13B, the capacitor portion 22 comprises the varicap diode 36 and a capacitor 48 connected in series with each other. In the example of FIG. 14A, the capacitor portion 22 comprises the varicap diode 36 and a capacitor 49 connected in parallel to each other. Moreover, in the example of FIG. 14B, the capacitor portion 22 comprises a parallel circuit in which the series combination of the varicap diode 36 and the capacitor 48, and the capacitor 49 are connected in parallel to each other.

In the examples of FIG. 13B, and FIGS. 14A and 14B, the series combination of the resistor 37 and the capacitor 38 is connected to the cathode side of the varicap diode 36, and the voltage input portion 39 is electrically connected to the node X between the resistor 37 and the capacitor 38, similarly to the example of FIG. 13A.

In the third embodiment, the capacitor portion 22 contains the varicap diode 36, and the voltage input portion 39 for determining the parasitic capacitance of the varicap diode 36 is connected to the capacitor portion 22. Therefore, the capacitance C of the capacitor portion 22 can be varied by changing the voltage to be applied to the voltage input portion 39. Thus, the higher and lower frequency bands for transmitting and receiving radio waves can be simply varied and set. By providing the characteristic configuration, as described above in the third embodiment, the higher and lower frequency bands can be varied and set correspondingly to the specifications without need of change in the design of the antenna conductor portion 2.

Moreover, since the varicap diode 36 of which the parasitic capacitance can be continuously varied correspondingly to the applied voltage is used, the capacitance C of the capacitor portion 22 can be continuously varied. Thus, the higher and lower frequency bands can be accurately set in compliance with the specifications.

Hereinafter, a fourth embodiment of the present invention will be described. In the fourth embodiment, an example of radio equipment will be explained. The radio equipment of the fourth embodiment is a portable telephone 35 as shown in FIG. 15. A circuit substrate 52 is contained in a case 51. The antenna device 1 and a change-over portion 53, a transmission-reception circuit 54 for the higher frequency band, and a transmission-reception circuit 55 for the lower frequency band are provided on the circuit substrate 52.

In the fourth embodiment, characteristically, the antenna device has the peculiar configuration described in the respective embodiments.

In the portable telephone 35, when the change-over operation of the change-over portion 53 switches on the transmission-reception circuit 54 for operation in the higher frequency band, the antenna device 1 transmits and receives a radio wave in the predetermined higher frequency band, due to the operation of the transmission-reception circuit 54. On the other hand, when the transmission-reception circuit 55 for operation in the lower frequency band is switched on, the antenna device 1 transmits and receives a radio wave in the set lower frequency band, due to the operation of the transmission-reception circuit 55.

In the fourth embodiment, the antenna device 1 described in the above-described respective embodiments is provided. Accordingly, radio waves in the two different, that is, higher and lower frequency bands can be transmitted and received by providing only one antenna device 1. Thus, the radio equipment can be reduced in size. No complicated change-over circuit for changing the higher and lower frequency bands is provided for the antenna device 1. Accordingly, problems of reduction in the antenna sensitivity due to the increased conduction loss, and increase of the cost caused by the above-described complicated change-over circuit, can be reduced. Thus, radio equipment having a high reliability and antenna sensitivity can be inexpensively provided.

The present invention is not restricted to the above-described embodiments. A variety of embodiments are available. For example, in the above-described respective embodiments, the 1.5 GHz band is typically described as the higher frequency, and the 800 MHz band is represented as the lower frequency band.

Needless to say, the higher and lower frequency bands can be set optionally and appropriately, and are not limited to the frequency bands described in the respective embodiments.

Furthermore, in the above-described embodiments, the antenna conductor portion 2 is configured so as to have an electrical length equal to about one fourth of the wavelength of a radio wave having the center frequency $f_H$ in the higher frequency band. As described above, the inductance of the antenna conductor portion 2 can be varied, based on the capacitive impedance characteristic of the LC parallel resonance circuit 3 in the higher frequency band of which the frequency is higher than the resonance frequency fβ of the LC parallel resonance circuit 3. Accordingly, the antenna conductor portion 2 can resonate at the center frequency $f_H$ in the higher frequency band by setting the circuit constants of the LC parallel resonance circuit 3, provided that the antenna conductor portion 2 is configured so as to have an electrical length equal to one fourth of a radio wave of which the wavelength is lower than the center frequency $f_H$ in the higher frequency band and is higher than the center frequency in the lower frequency band. Thus, the antenna conductor portion 2 is not restricted to an electrical length equal to one fourth of the wave length of a radio wave having the center frequency in the higher frequency band. The antenna conductor portion 2 may have an electrical length equal to one fourth of the wavelength of a radio wave of which the frequency is lower than the center frequency $f_H$ in the higher frequency band and is higher than the center frequency $f_L$ in the lower frequency band.

When the antenna conductor portion 2 has an electrical length shorter than about one fourth of the wavelength of a radio wave having the center frequency in the higher frequency band, an inductor 60 is preferably incorporated in the antenna conductor portion 2 and the LC parallel resonance circuit 3, as shown in FIG. 16.

Moreover, in the above-described embodiments, the matching circuit 4 comprises the inductor 24. The matching circuit 24 may comprise a series circuit of an inductor 61 and a capacitor 62, and an inductor connected in parallel to the series circuit, as shown in FIG. 17. In the case in which the matching circuit 4 is configured as shown in FIG. 17, the impedances in both of the higher and lower frequency bands can be easily matched compared to the case where the matching circuit 4 comprises the inductor 24 only.

Furthermore, in the second embodiment, the antenna device 1 is configured so that the inductance of the inductor portion 23 are changed in the two steps. The inductance of the inductor portion 23 may be changed in at least three steps. In this case, for example, the inductor portion 23 comprises a series combination of at least three inductors. The bypass conduction path 33 and the switch portion (PIN diode 29 ) are connected in parallel to at least two inductors of the series combination. The inductance of the inductor portion 23, configured as described above, can be changed in at least three steps. Thus, the lower frequency band can be changed in at least three steps to be set, due to the configuration by which the inductance of the inductor portion 23 can be changed in at least three steps, as described above.

Moreover, in the second embodiment, the antenna device 1 is configured so that the inductance of the inductor portion 23 is changed by using the PIN diode 29. A switch portion in a form excluding a PIN diode may be provided instead of the PIN diode 29.

Moreover, in the fourth embodiment, a portable telephone is described as an example of radio equipment to which the antenna device having the characteristic according to the present invention. The antenna device according to the present invention may be mounted to other radio equipment.

According to the present invention, the antenna device contains the antenna conductor portion having a resonance frequency which is lower than the center frequency in the higher frequency band for transmitting and receiving radio waves and is higher than the center frequency in the lower frequency band for transmitting and receiving radio waves, and the LC parallel resonance circuit connected in series with the power supply side of the antenna conductor portion, and moreover, the LC parallel resonance circuit is configured so as to resonate at a frequency nearly equal to the center frequency in the lower frequency band and be capable of rendering, to the antenna conductor portion, a capacitance for causing the antenna conductor portion to resonate at the center frequency in the higher frequency band. Accordingly, transmission and reception of radio waves in the two different frequency bands can be carried out without need of a circuit for changing the upper and lower frequency bands.

A complicated circuit for changing the upper and lower frequency bands is not needed, as described above. This solves problems in that the antenna sensitivity deteriorates by increase in the conduction loss, and the cost is increased, which may be caused by the complicated change-over circuit.

Therefore, the antenna device which can perform transmission and reception of radio waves in two different frequency bands at high sensitivity, and of which the reliability of the antenna characteristics is high can be provided at a low cost.

The above-described advantages can be obtained, depending on the shapes and sizes of the antenna conductor portion, for example, comprising the conductor sheet member or conductor wire member, the conductor portion for transmitting and receiving radio waves formed on a substrate, and also, the combination of the conductor portion formed on the substrate with the conductor sheet member or conductor wire member electrically connected to each other.

Preferably, in one embodiment, the capacitor portion constituting the LC parallel resonance circuit is configured so as to contain a varicap diode, and the voltage input portion for determining the parasitic capacitance of the varicap diode is electrically connected to the capacitor portion. In this case, the capacitance of the capacitor portion of the LC parallel resonance circuit can be varied and set simply by changing the voltage applied to the voltage input portion. Thus, the upper and lower frequency bands can be conveniently varied and set. Since the parasitic capacitance of the varicap diode can be continuously varied correspondingly to the applied voltage, the upper and lower frequency bands can be set at high accuracy in compliance with the specifications.

Also, preferably, the change-over circuit for changing the inductance of the inductor portion of the LC parallel resonance circuit in plural steps to vary and set the lower frequency band is formed. In this case, the lower frequency band can be conveniently changed by changing the inductance of the inductor portion of the LC parallel resonance circuit by means of the change-over circuit. Thus, an antenna device capable of being mounted to plural types of radio equipment having different lower frequency bands can be provided.

Preferably, the change-over circuit comprises the bypass conduction path and the switching portion. In this simple circuit configuration, the inductance of the inductor portion of the LC parallel resonance circuit can be changed. Accordingly, increase in the size of the antenna device can be suppressed.

In the radio equipment including the antenna device according to the present invention, the reliability of the antenna characteristics can be enhanced, and also, the cost reduction can be achieved.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. An antenna device which can transmit and receive radio waves in two different frequency bands including a lower frequency band and a higher frequency band, comprising:

an antenna conductor portion having a resonance frequency which is lower than a center frequency in the higher frequency band and is higher than a center frequency in the lower frequency band; and an LC parallel resonance circuit connected in series with a power supply side of the antenna conductor portion, wherein the LC parallel resonance circuit is configured so as to resonate at a frequency approximately equal to the center frequency in the lower frequency band, causing the antenna conductor portion to resonate at the center frequency in the lower frequency band, and so as to provide a capacitance for causing the antenna conductor portion to resonate at the center frequency in the higher frequency band.

2. The antenna device of claim 1, wherein the antenna conductor portion comprises a conductor sheet member or conductor wire member having an electrical length equal to about one quarter of the wavelength of a radio wave having a frequency between the center frequency in the higher frequency band and the center frequency in the lower frequency band.

3. The antenna device of claim 2, wherein a change-over circuit for changing the inductance of an inductor portion of the LC parallel resonance circuit in plural steps to vary and set the lower frequency band is connected to the inductor portion.

4. The antenna device of claim 3, wherein the inductor portion comprises plural inductors connected in series to each other, a bypass conduction path is provided in parallel to at least one of the plural inductors of the inductor portion, a switching portion for controlling on-off conduction of the bypass conduction path so that the on-off conduction of the inductor connected in parallel to the bypass conduction path is controlled, is incorporated in the bypass conduction path, and the bypass conduction path and the switching portion comprise the change-over circuit for changing the inductance of the inductor portion to vary and set the lower frequency band.

5. The antenna device of claim 1, wherein the antenna conductor portion comprises a conductor portion for transmitting and receiving a radio wave, formed on a substrate, and the antenna conductor portion has an electrical length equal to about one quarter of the wavelength of a radio wave having a frequency between the center frequency in the higher frequency band and the center frequency in the lower frequency band.

6. The antenna device of claim 5, wherein a change-over circuit for changing the inductance of an inductor portion of the LC parallel resonance circuit in plural steps to vary and set the lower frequency band is connected to the inductor portion.

7. The antenna device of claim 6, wherein the inductor portion comprises plural inductors connected in series to each other, a bypass conduction path is provided in parallel to at least one of the plural inductors of the inductor portion, a switching portion for controlling on-off conduction of the bypass conduction path so that the on-off conduction of the inductor connected in parallel to the bypass conduction path is controlled, is incorporated in the bypass conduction path, and the bypass conduction path and the switching portion comprise the change-over circuit for changing the inductance of the inductor portion to vary and set the lower frequency band.

8. The antenna device of claim 1, wherein the antenna conductor portion comprises a combination of a conductor portion for transmitting and receiving a radio wave, formed on a substrate, and a conductor sheet member or conductor wire member electrically connected to each other, and the combination has an electrical length equal to about one quarter of the wavelength of a radio wave having a frequency between the center frequency in the higher frequency band and the center frequency in the lower frequency band.

9. The antenna device of claim 4, wherein a change-over circuit for changing the inductance of an inductor portion of the LC parallel resonance circuit in plural steps to vary and set the lower frequency band is connected to the inductor portion.

10. The antenna device of claim 9, wherein the inductor portion comprises plural inductors connected in series to each other, a bypass conduction path is provided in parallel to at least one of the plural inductors of the inductor portion, a switching portion for controlling on-off conduction of the bypass conduction path so that the on-off conduction of the inductor connected in parallel to the bypass conduction path is controlled, is incorporated in the bypass conduction path, and the bypass conduction path and the switching portion comprise the change-over circuit for changing the inductance of the inductor portion to vary and set the lower frequency band.

11. The antenna device of claim 1, wherein a capacitor portion of the LC parallel circuit is configured so as to contain at least a varicap diode having a parasitic capacitance variable depending on an applied voltage, and a voltage input portion for determining the parasitic capacitance of the varicap diode is electrically connected to the capacitor portion.

12. The antenna device of claim 11, wherein a change-over circuit for changing the inductance of an inductor portion of the LC parallel resonance circuit in plural steps to vary and set the lower frequency band is connected to the inductor portion.

13. The antenna device of claim 12, wherein the inductor portion comprises plural inductors connected in series to each other, a bypass conduction path is provided in parallel to at least one of the plural inductors of the inductor portion, a switching portion for controlling on-off conduction of the bypass that the on-off conduction of the inductor connected in parallel to the bypass conduction path is controlled, is incorporated in the bypass conduction path, and the bypass conduction path and the switching portion comprise the change-over circuit for changing the inductance of the inductor portion to vary and set the lower frequency band.

14. The antenna device of claim 1, wherein a change-over circuit for changing the inductance of an inductor portion of the LC parallel resonance circuit in plural steps to vary and set the lower frequency band is connected to the inductor portion.

15. The antenna device of claim 14, wherein the inductor portion comprises plural inductors connected in series to each other, a bypass conduction path is provided in parallel to at least one of the plural inductors of the inductor portion, a switching portion for controlling on-off conduction of the bypass conduction path so that the on-off conduction of the inductor connected in parallel to the bypass conduction path is controlled, is incorporated in the bypass conduction path, and the bypass conduction path and the switching portion comprise the change-over circuit for changing the inductance of the inductor portion to vary and set the lower frequency band.

16. Radio equipment comprising at least one of a transmitter and a receiver and an antenna device coupled to the at least one of a transmitter and receiver, the antenna device being capable of transmitting and receiving radio waves in two different frequency bands including a lower frequency band and a higher frequency band, the antenna device comprising:

an antenna conductor portion having a resonance frequency which is lower than a center frequency in the higher frequency band and is higher than a center frequency in the lower frequency band; and an LC parallel resonance circuit connected in series with a power supply side of the antenna conductor portion, wherein the LC parallel resonance circuit is configured so as to resonate at a frequency approximately equal to the center frequency in the lower frequency band, causing the antenna conductor portion to resonate at the center frequency in the lower frequency band, and so as to provide a capacitance for causing the antenna conductor portion to resonate at the center frequency in the higher frequency band.

17. The radio equipment of claim 16, wherein the antenna conductor portion comprises a conductor sheet member or conductor wire member having an electrical length equal to about one quarter of the wavelength of a radio wave having a frequency between the center frequency in the higher frequency band and the center frequency in the lower frequency band.

18. The radio equipment of claim 16, wherein the antenna conductor portion comprises a conductor portion for transmitting and receiving a radio wave, formed on a substrate, and the antenna conductor portion has an electrical length equal to about one quarter of the wavelength of a radio wave having a frequency between the center frequency in the higher frequency band and the center frequency in the lower frequency band.

19. The radio equipment of claim 16, wherein the antenna conductor portion comprises a combination of a conductor portion for transmitting and receiving a radio wave, formed on a substrate, and a conductor sheet member or conductor wire member electrically connected to each other, and the combination has an electrical length equal to about one quarter of the wavelength of a radio wave having a frequency between the center frequency in the higher frequency band and the center frequency in the lower frequency band.

20. The radio equipment of claim 16, wherein a capacitor portion of the LC parallel circuit is configured so as to contain at least a varicap diode having a parasitic capacitance variable depending on an applied voltage, and a voltage input portion for determining the parasitic capacitance of the varicap diode is electrically connected to the capacitor portion.

21. The radio equipment of claim 16, wherein a change-over circuit for changing the inductance of an inductor portion of the LC parallel resonance circuit in plural steps to vary and set the lower frequency band is connected to the inductor portion.

22. The radio equipment of claim 21, wherein the inductor portion comprises plural inductors connected in series to each other, a bypass conduction path is provided in parallel to at least one of the plural inductors of the inductor portion, a switching portion for controlling on-off conduction of the bypass conduction path so that the on-off conduction of the inductor connected in parallel to the bypass conduction path is controlled, is incorporated in the bypass conduction path, and the bypass conduction path and the switching portion comprise the change-over circuit for changing the inductance of the inductor portion to vary and set the lower frequency band.

* * * * *